US005674363A

United States Patent [19]

Huovila et al.

[11] Patent Number: 5,674,363

[45] Date of Patent: Oct. 7, 1997

[54] METHOD AND DEVICE IN THE REGULATION OF A HEADBOX

[75] Inventors: Jyrki Huovila, Muurame; Petri Nyberg; Olavi Viitanen, both of Jyväskylä, all of Finland

[73] Assignee: Valmet Paper Machinery, Inc., Helsinki, Finland

[21] Appl. No.: 269,345

[22] Filed: Jun. 30, 1994

[30] Foreign Application Priority Data

Jul. 1, 1993 [FI] Finland ..... 933029

[51] Int. Cl.[6] ..... D21F 1/06

[52] U.S. Cl. ..... 162/216; 162/212; 162/336; 162/252; 366/180

[58] Field of Search ..... 162/343, 336, 162/344, 216, 252, 203, 212; 264/518; 366/150, 160, 165, 173, 177, 180

[56] References Cited

U.S. PATENT DOCUMENTS

| | | | |
|---|---|---|---|
| 4,146,425 | 3/1979 | Gutzeit | 162/252 |
| 4,640,810 | 2/1987 | Laursen et al. | 264/518 |
| 4,792,380 | 12/1988 | Tuomikoski | 162/344 |
| 4,879,003 | 11/1989 | Reed | 162/344 |
| 5,022,965 | 6/1991 | Pitkajarvi | 162/192 |
| 5,030,326 | 7/1991 | Nous | 162/258 |
| 5,149,402 | 9/1992 | Riddick | 162/336 |
| 5,316,383 | 5/1994 | Begeman | 366/160 |

FOREIGN PATENT DOCUMENTS

| | | |
|---|---|---|
| 0462472 | 12/1991 | European Pat. Off. . |
| 912230 | 5/1991 | Finland . |
| 4112347 | 10/1992 | Germany . |
| 4323263 | 1/1994 | Germany . |

*Primary Examiner*—David L. Lacey
*Assistant Examiner*—Calvin Padgett
*Attorney, Agent, or Firm*—Steinberg, Raskin & Davidson, P.C.

[57] ABSTRACT

A method in the regulation of a pulp suspension flow through the headbox of a paper machine/board machine wherein an additional flow is introduced into the pulp suspension at different points across the width of the headbox. The concentration of the additional flow is regulated by a mixer unit which includes a displaceable distributor part such that when the mixing ratio is being regulated, the flow resistances of the component flows, of the additional flow, entering into the mixer unit are adjusted by displacing the distributor part of the mixer unit in a chamber of the mixer unit.

19 Claims, 12 Drawing Sheets

METHOD AND DEVICE IN THE REGULATION OF A HEADBOX

BACKGROUND OF THE INVENTION

The present invention relates to a method and device in the regulation of the headbox of a paper/board machine, by means of which method and device it is possible to reliably act upon the grammage profile of the paper across the width of the paper web and also to act upon the fiber orientation profile in the paper web across the width of the paper web. The present invention also relates to a headbox utilizing the method and device in accordance with the invention.

As is known from the prior art, the discharge flow of the pulp suspension out of the headbox must have a substantially uniform velocity in the transverse direction of the paper machine. A transverse flow produces distortion of the fiber orientation and adversely affects the quality factors of the paper produced, such as the dimensional stability of the paper in connection with changes in moisture. In particular, it is an important requirement that the main axes of the directional distribution, i.e. orientation, of the fiber mesh in the paper coincide with the directions of the main axes of the paper and that the orientation is symmetric in relation to these axes.

At the edges of the pulp-flow duct in the headbox, owing to the vertical walls, there is a higher friction. This edge effect produces a very strong linear distortion in profiles of the web. Profile faults in the turbulence generator of the headbox usually produce a non-linear distortion in the profile inside the lateral areas of the flow ducts.

Attempts are made to compensate for an unevenness of the grammage profile arising from the drying-shrinkage of paper by means of a crown formation of the slice, so that the slice is thicker in the middle of the pulp jet. It is a phenomenon in the manufacture of paper that when the paper web is dried, it shrinks in the middle area of the web to a lower extent than in the lateral areas. The shrinkage is typically, in the middle area of the web from about 1% to about 3% and in the lateral areas of the web from about 4% to about 6%. This shrinkage profile produces a corresponding change in the transverse grammage profile of the web so that, owing to the shrinkage, the dry grammage profile of a web whose transverse grammage profile was uniform, is changed after the press and during the drying so that, in both of the lateral areas of the web, the grammage is slightly higher than in the middle area. As is known from the prior art, this grammage profile has been regulated by means of the profile bar so that the profile bar of the headbox is kept more open in the middle area of the headbox than in the lateral areas of the headbox.

By means of this type of arrangement, the pulp suspension is forced to move toward the middle area of the web. However, these circumstances further affect the alignment of the fiber orientation. The main axes of the directional distribution, i.e. orientation, of the fiber mesh should coincide with the directions of the main axes of the paper, and the orientation should be symmetric in relation to these axes. In the regulation of the profile bar, a change in the orientation is produced as the pulp suspension flow receives components in the transverse direction.

Regulation of the lip of the headbox also produces a change in the transverse flows of the pulp jet even though the objective of the regulation is exclusively to affect the grammage profile, i.e. the thickness profile of the pulp suspension layer that is fed. Thus, the transverse flows have a direct relationship with the distribution of the fiber orientation.

From the prior art, specific devices are known by whose means attempts are made to regulate the fiber orientation, and other devices are known by whose means attempts are made to regulate the grammage profile of the web. However, when the grammage profile is regulated in a prior art device by means of the profile bar, the fiber orientation in the web is unavoidably also affected at the same time.

From the prior art, a method is known in the headbox of the paper machine to control the distortion of the fiber orientation in the paper web. In such a method, medium flows are passed into lateral passages placed at the level of the turbulence generator of the headbox, and, by regulating the magnitudes and the mutual proportions of these flows, the transverse flows of the pulp suspension are affected, and thereby the distortion of the fiber orientation is regulated. By means of the flows introduced into the lateral passages, a transverse flow velocity is produced which compensates for the distortion of the fiber orientation.

From the assignee's Finnish Patent Application No. 884408 of earlier date, a method is known in the headbox of a paper machine to control the distribution of the fiber orientation of the paper web in the transverse direction of the machine. In the method described in FI '408, the transverse velocity component of the discharge jet is regulated by appropriately aligning a turbulence tube of a turbulence generator.

By means of the above mentioned prior art methods for controlling the fiber orientation in the paper web, it is usually possible to control only the linear distortion profiles. As such, the prior art methods are suitable for the control of the fiber orientation, but, when they are used, commonly even a large nonlinear residual fault remains in comparison with an even distribution of the orientation. The prior art methods are well suitable for basic regulation of the distortion of the orientation. However, by means of the prior art methods, it is not possible to regulate individual faults, which may occur in the orientation in the middle area of the web and which arise, e.g., from defects in the pipe system of the turbulence generator.

A number of methods are also known for the regulation of the profile bar, in which, while the grammage profile is measured, the position of the profile bar in the headbox of the paper machine is changed. In addition, by means of the profile bar, the thickness of the pulp suspension discharged onto the wire, and thereby, the grammage of the paper web are affected. In the manner described above, this regulation produces faults in the orientation because, by means of the regulation, the flow is throttled elsewhere, whereby components of transverse velocity are produced in the flow.

In the prior art, reference is also made to the Finnish Patent Application No. 912230 which describes a headbox that has been divided across its width into compartments by means of partition walls and in which, in an individual compartment, there is at least one inlet duct for the passage of a component flow. Moreover, in the device described in FI 912230, a mixer is connected in front of the individual inlet duct by whose means the pulp suspension ratio can be regulated. In the device of FI 912230, it has, however, not been possible to adequately regulate the mixing ratio without a change in the flow quantity.

OBJECTS AND SUMMARY OF THE INVENTION

Accordingly, it is an object of the present invention to provide novel solutions for the problems discussed above.

It is an object of the present invention to provide a new and improved method and device by whose means the consistency of the pulp suspension can be regulated without producing a change in the flow quantity.

It is another object of the present invention to provide a new and improved method and device by whose means it is possible to regulate the pressure level of the overall flow departing from the mixer and, thus, the flow quantity and the flow velocity while the mixing ratio remains at its specified invariable value.

In the device of the present invention, the mixer comprises a distributor part, by whose means both the throttle, i.e. the flow resistance, of the inlet duct for a first component flow connected with the mixer and the throttle, i.e. the flow resistance, of the flow in the inlet duct for a second component flow connected with the mixer are regulated at the same time.

By means of the device and the method in accordance with the invention, it is possible to reliably control the grammage orientation profile of the paper web across the web width, and it is also possible to control the fiber orientation profile of the paper web across the web width.

In the device and method in accordance with the invention, the grammage profile is affected by adding to the pulp flow, a component flow whose concentration differs from the average concentration of the pulp flow.

In the device and method in accordance with the invention, two component flows are introduced into a mixer, and the mixing ratio is regulated continuously so that, when the throttle of the pulp flow or 0-water flow in one component-flow duct is increased, the throttle of the other component flow is reduced, or vice versa. Thus, in the regulation method and device, the concentration of the overall pulp flow departing from the mixer is affected continuously and, yet, the quantity of the concentration is kept invariable and constant.

In the mixer, it is possible to add to the pulp flow, for example, water alone, 0-water, or a diluted pulp suspension whose concentration and/or chemical composition differ(s) from the concentration of the main pulp flow. The pulp suspension that has been regulated in the mixer is then passed into the main pulp flow. In the prior art devices, the grammage profile was altered by acting upon the pressure in the discharge duct by means of the profile bar. In accordance with the invention, a profile bar is not needed necessarily, because the fiber orientation profile is regulated by means of local component flows passed into different positions of width across the headbox.

In accordance with the invention, the headbox comprises separate blocks positioned at different locations across the width of the headbox. An additional flow is fed into the blocks, whose consistency has been regulated to the desired level and by means of which additional flow a fault in the grammage profile occurring in a certain width position of the web is corrected thereby constituting means for correcting an undesirable variation in the grammage profile. Thus, it is possible to introduce a pulp suspension thicker than average or a pulp suspension more dilute than average into a certain position of width of the headbox, depending on the measured grammage profile error, so as to correct the grammage profile error. However, it is essential in the regulation of the grammage profile that, during the regulation of the concentration, the flow quantity or rate of the additional flow is kept invariable and that, thus, during the regulation of the consistency, no changes are produced in the overall flow velocity profile of the pulp suspension in the headbox. Thus, by means of the width specific additional flows in the headbox, in the regulation of the consistency, the consistency of the pulp suspension is affected at a certain position of width only. Thus, by means of the width specific additional flows faults occurring in the grammage profile are corrected.

Also, in the device and method in accordance with the invention, it is possible to regulate the fiber orientation, the pressure profile, and thereby the velocity profile by regulating the flow quantities of the additional width specific flows while the mixing ratio remains at its regulated value. Thus, when the fiber orientation profile is desired to be corrected, the flow velocity profile coming out of the pipe system of the turbulence generator is locally affected in the direction of width of the web by means of regulation of the flow quantities of the additional width specific flows. In this manner, at a certain position of width of the web, locally the pressure level and thereby the flow velocity and further the flow quantity or rate are increased, or, if necessary, reduced. In this way it is possible to act upon local profile faults occurring in the fiber orientation.

In the method in accordance with the invention in the regulation of the headbox the concentration of the additional flow is regulated by means of a mixer unit which comprises a displaceable distributor part. When the mixing ratio is being regulated, the flow resistances of the component flows entering into the mixer unit are adjusted by displacing the distributor part of the mixer unit situated in a chamber of the mixer unit.

In the device in accordance with the invention in the regulation of the headbox, with a view toward providing means for adjusting the concentration of the additional flow to the desired level, the device comprises a mixer unit into which at least two component flows are passed, inlet ducts for the component flows and a displaceable distributor part in the chamber of the mixer unit. The distributor part can be brought into different covering positions in relation to the end openings of the inlet ducts for the component flows. By means of the mixer unit, i.e., by displacing the distributor part of the mixer unit in the chamber, the throttle of the component flow is increased, and the throttle of the other component flow is reduced by the corresponding amount, and vice versa.

In the following, the invention will be described in detail with reference to some exemplifying embodiments of the invention illustrated in the figures in the accompanying drawing, the invention being by no means strictly confined to the details of the embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
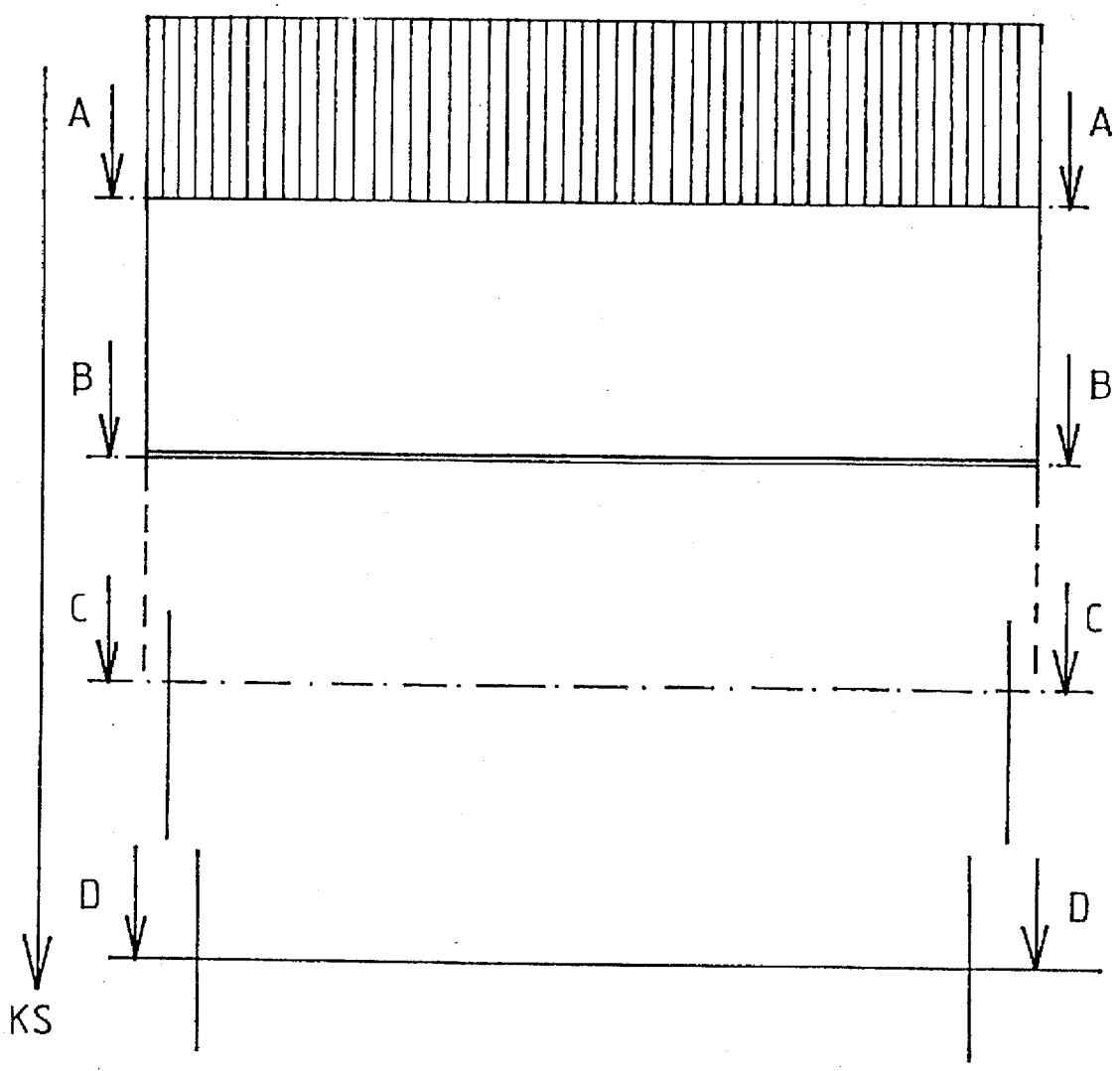
FIG. 1 illustrates the development of different profiles when proceeding in the machine direction of the paper machine from the turbulence generator.

FIG. 1 shows the development of different profiles when proceeding in the machine direction of the paper machine from a turbulence generator to a forming wire and forward therefrom. In the description related to FIG. 1, reference is made to the different positions illustrated in the figure when moving forwards from the turbulence generator in the direction of flow of the pulp suspension in the paper machine.

Section A—A:

At the beginning of the slice cone, the flow state after the turbulence generator (TG) consists of the pressure and thickness profiles. In the embodiments that are commonly used, attempts are made to make these profiles as straight as possible.

If the pressure profile of the feed from the turbulence generator TG is not uniform, the velocity profile in the machine direction (KS) tends to be equalized during the acceleration in the slice cone and produces transverse flow components. The transverse flows are retained up to the free jet and produce a directional-angle profile in the jet.

Section B—B:

In the applications that are commonly used, the fiber grammage profile is regulated by profiling the thickness profile of a pulp of uniform consistency, e.g., by means of the profile bar. This, however, produces transverse volumetric flows, which are also seen in the directional profile of the jet, which may partly also arise from the pressure profile of the section A—A.

Section C—C

The fiber suspension is filtered on the wire part, after which the individual fibers have been bound into the structure of the paper. The fibers are oriented in accordance with the difference between the direction and velocity of the jet coming from the headbox and velocity and running direction of the wire (filtered material). In local filtering, there may be differences arising from local variations in retention.

Section D—D:

Depending on the moisture profile and on differences in the transverse holding forces, the paper web shrinks unevenly during drying. In an area that shrinks extensively, the fibers and the fillers in the paper move closer to each other, whereby the grammage in the area increases and produces a need to lower the grammage.

Thus, besides upon the grammage profile of the fibers, regulation of the grammage profile by means of the profile bar also acts upon the directional profile of the jet. Regulation of the thickness profile of the jet could be omitted entirely if the consistency profile after the turbulence generator TG could be regulated independently. In such a case, the jet is run as consistency-profiled and as of uniform thickness into the former. Further, when the pressure profile of the turbulence generator TG can be regulated, the directional-angle profile of the jet can be fine-adjusted separately.

Figure 2A:
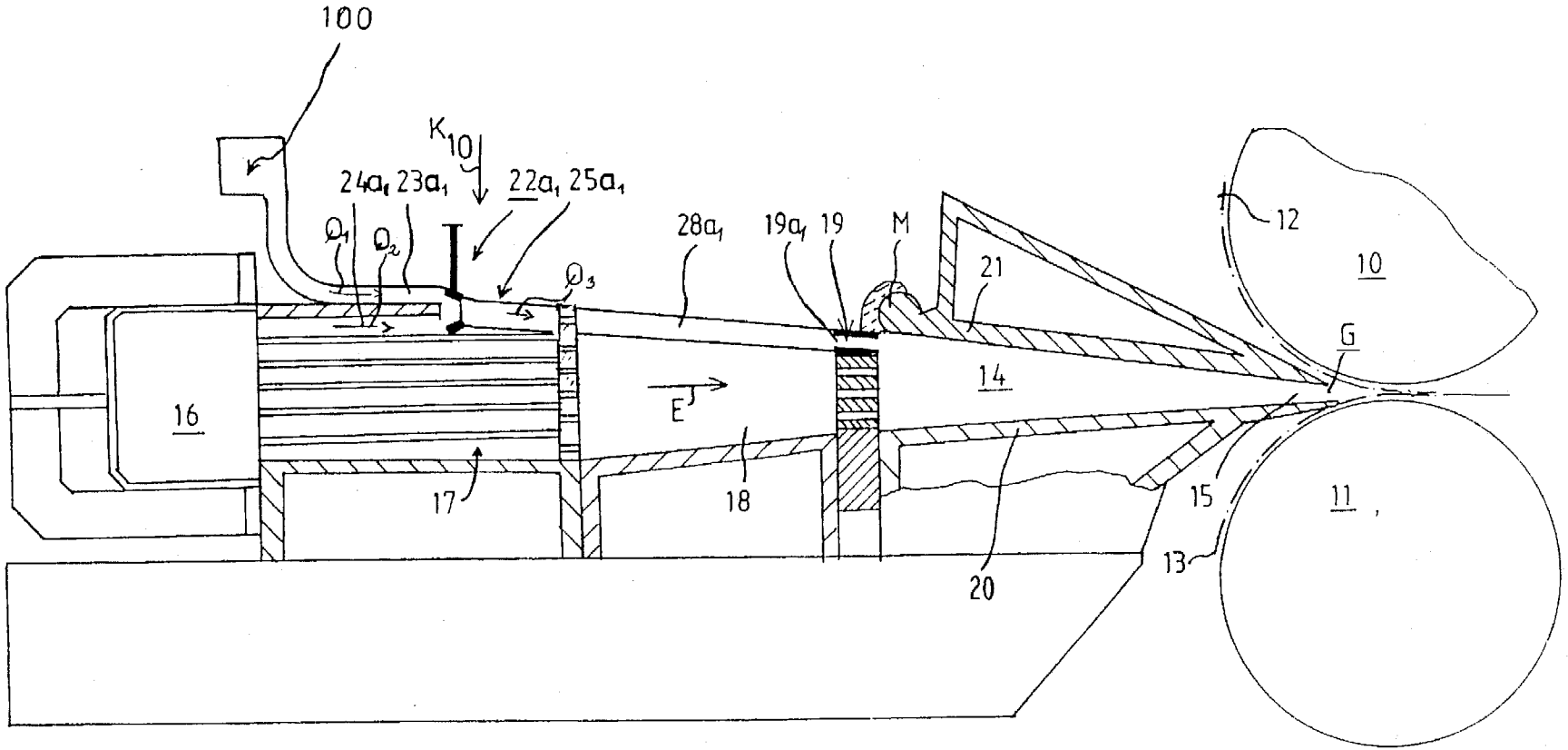
FIG. 2A is a sectional view of a headbox of a paper machine in accordance with the present invention.

FIG. 2A shows a headbox in accordance with the invention in connection with a twin-wire former. Of the former, FIG. 2A shows a pair of breast rolls 10 and 11 and forming wires 12 and 13 running over them and defining a forming gap G therebetween. Out of a discharge duct 14 of the headbox, a pulp suspension jet is fed through a slice 15 into the forming gap G defined by the wires 12 and 13.

Figure 2B:
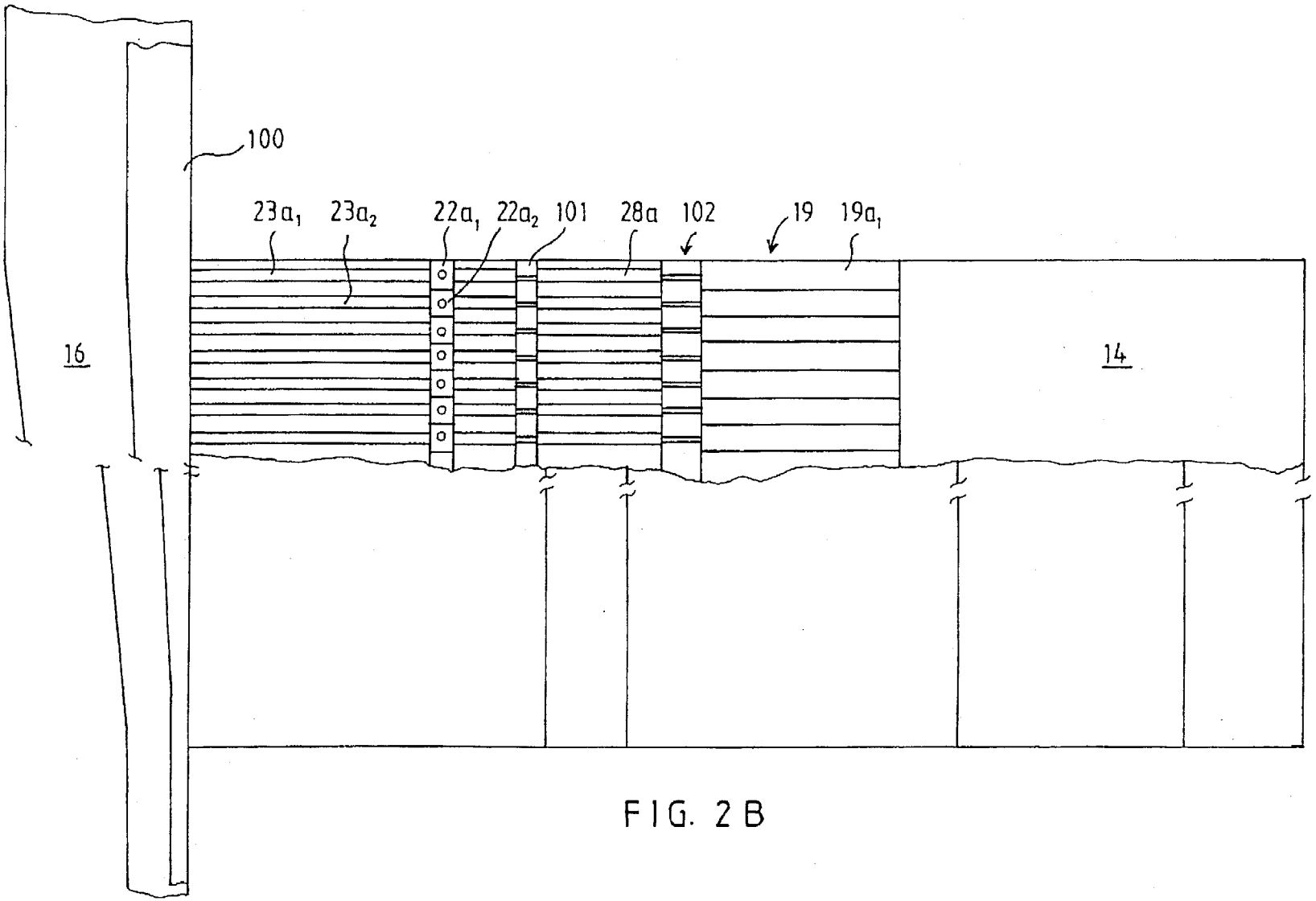
FIG. 2B is an illustration in the direction $K_{10}$ in FIG. 2A.

Proceeding in the flow direction E of the pulp suspension, the headbox comprises an inlet header 16, a distributor manifold 17, an equalizing chamber 18, a turbulence generator 19, and a discharge duct 14. The discharge duct 14 is defined by a stationary lower-lip wall 20 and by an upper-lip wall 21 pivoting around a horizontal articulated joint M. As shown in FIGS. 2A and 2B, the device comprises a mixer unit 22, into which a component flow $Q_1$ is introduced from an additional inlet header 100. Also, a second component flow $Q_2$ is introduced into the mixer unit 22, which flow is, in the embodiment shown in the figure, the pulp flow coming out of the inlet header 16. The flow $Q_1$ is preferably a diluting flow, whose concentration is, on the whole, different from the average concentration of the pulp suspension. The flow $Q_1$ consists preferably of diluting water. The combined flow $Q_3$ ($Q_1$+$Q_2$) is passed through a throttle point 101 into a distributor pipe 28*a* and further, out of the distributor pipe, through a throttle point 102, into a turbulence tube 19$a_1$ of the turbulence generator 19 and further into the discharge duct 14.

FIG. 2B is a top view of the device shown in FIG. 2A, being a partial illustration of principle. As is shown in the figure, there are several mixer units 22$a_1$,22$a_2$, . . . , 22$a_n$ placed side by side, and a diluting flow $Q_{1.1}$, $Q_{1.2}$, . . . , $Q_{1.n}$ passes into the respective mixer units out of the inlet header 100. In a corresponding manner, into each mixer unit 22$a_1$,22$a_2$, . . . , 22$a_n$, a pulp suspension flow $Q_{2.1}$, $Q_{2.2}$, . . . , $Q_{2.n}$ is passed out of the inlet header 16. The flows $Q_1$ and $Q_2$ are mixed together in each mixer unit 22$a_1$,22$a_2$, . . . and are thereupon passed into the discharge duct 14. Thus, by means of each mixer unit 22$a_1$,22$a_2$ . . . 22$a_n$, specifically in respect of each position along the width of the headbox, i.e., in a direction transverse to the flow direction of the pulp suspension, it is possible to regulate the grammage and the fiber orientation of the web at the particular position of width by means of a flow $Q_{3.1}$, $Q_{3.2}$, . . . , $Q_{3.n}$ passed into the pulp suspension. The regulations of the individual components of the flow are independent from one another.

Figure 3:
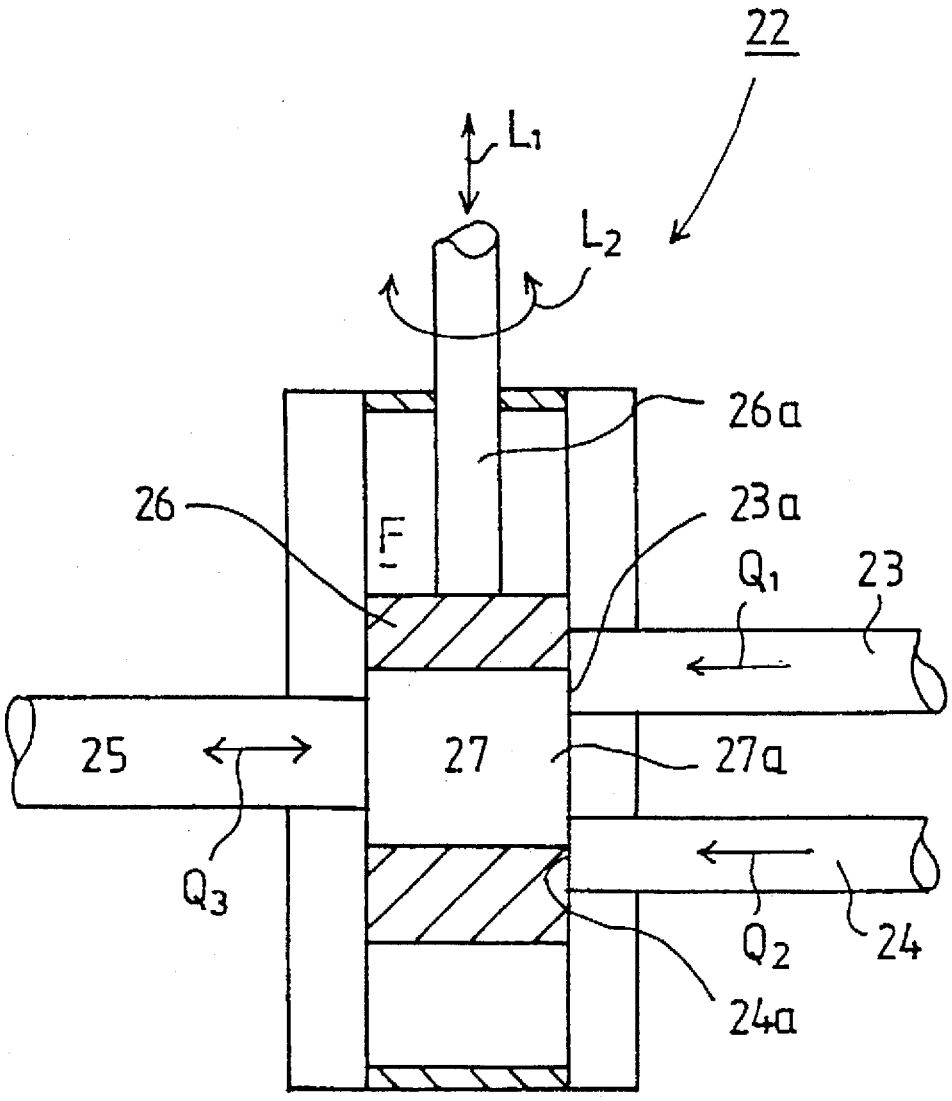
FIG. 3 is a partial illustration of principle of a mixer unit by whose means a fault in the grammage profile and a fault in the fiber orientation profile can be corrected locally in the direction of width of the web.

FIG. 3 shows a mixer unit 22 in accordance with the invention, by whose means it is possible to supply a pulp flow having a desired consistency to a certain position of width of the headbox of the paper machine. By means of the mixer unit shown in FIG. 3, it is possible to regulate the grammage profile. In a corresponding manner, by means of the mixer unit, it is possible to regulate the fiber orientation profile by acting upon the pressure loss in the pulp flow passing through the mixer unit and, thus, upon the velocity of the flow and further upon the flow quantity or rate. As is shown in the illustration of principle in FIG. 3, the mixer unit 22 comprises a first inlet duct 23, through which the component flow $Q_1$, preferably a so-called 0-water flow, is introduced into a chamber F defined within the mixer unit. Further, the mixer unit 22 comprises a second duct 24, through which the second component flow $Q_2$, which is preferably a component flow at the average concentration of the pulp suspension, is introduced into the chamber F of the mixer unit 22. The flows pass, at the consistency ratio distributed by a distributor part 26, through a transverse duct 27 of the distributor part 26, placed in the chamber F, into an outlet duct 25. The combined flow $Q_3=Q_1+Q_2$ is passed to a certain position along the width of the headbox of the paper machine. In accordance with the invention, each position of width of the paper machine comprises a separate duct $27a_1, 27a_2 \ldots$, in front of which there is a mixer unit $22a_1, 22a_2, 22a_3 \ldots$, by whose means it is possible to regulate the concentration of the pulp suspension departing from the mixer units, and favorably also the flow velocity of the pulp suspension and, thus, the flow quantity or rate.

As shown in FIG. 3, the distributor part 26 can be displaced along a linear path (arrow $L_1$) in the chamber F, and the distributor part 26 can also be rotated (arrow $L_2$) in the chamber F. Upon rotation of the distributor part 26, a mouth part 27*a* of the flow duct 27 extending across the distributor part 26 can be brought into different positions in relation to the end openings 23*a*,24*a* of the inlet ducts 23 and 24. Thus, the flows $Q_1, Q_2$ in the ducts 23 and 24 can be regulated by increasing the throttle, i.e. the flow resistance, of the flow $Q_1$ in the duct 23 and reducing the throttle, i.e. the flow resistance, of the flow $Q_2$ in the duct 24, or vice versa. This regulation is achieved because the size of the mouth part varies upon rotation of the distributor part 26. By shifting the distributor part 26 along a linear path, the mixing ratio of the flow $Q_3$ is affected whereas the rotation of the distributor part 26 affects the pressure loss in the flow $Q_3$.

Figure 4A:
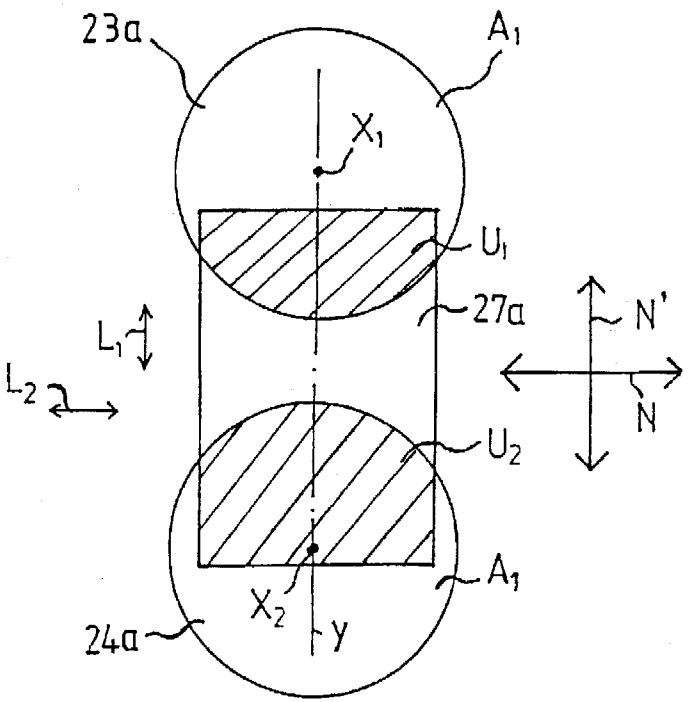
FIG. 4A is an illustration of principle of a first position of flow regulation.

FIG. 4A is an illustration of principle of the regulation achieved in accordance with the invention. In the regulation position of FIG. 4A, the flow has access through the sectional flow areas $U_1$ and $U_2$ denoted by the shading into the duct 27 in the distributor part 26. The end opening of the duct 23 is denoted by 23*a*, and the end opening of the duct 24 is denoted by 24*a*. The sectional flow area of the end opening 23*a* is $A_1$, and it corresponds to the sectional flow area of the end opening 24*a* (provided ducts 23 and 24 have the same dimensions). The shapes of the openings 23*a* and 24*a* are similar to one another. The central axis of the opening 23*a* is denoted by $X_1$, and the central axis of the opening $24_a$ is denoted by $X_2$. The connecting line of the axes $X_1$ and $X_2$ is denoted by Y. The orifice of the flow duct 27 in the regulation part 26 is denoted by 27*a* in the figure. When the overall flow quantity $Q_3$ is desired to be increased, the sectional flow area $U_1, U_2$ is increased through which the flow takes place into the duct 27 in the regulation part 26 and (in the way shown in the figure) the distributor part 26 is raised or lowered perpendicularly to the line Y (in the direction N). In a corresponding manner, when only the mixing ratio of the flows $Q_1$ and $Q_2$ is desired to be changed, the orifice 27*a* is displaced in the direction N', which is perpendicular to the direction N. The flow openings 23*a*,24*a* are arranged in relation to one another that at least one of the central planes coincide and that at least one central planes perpendicular to the central planes are parallel to one another.

Figure 4B:
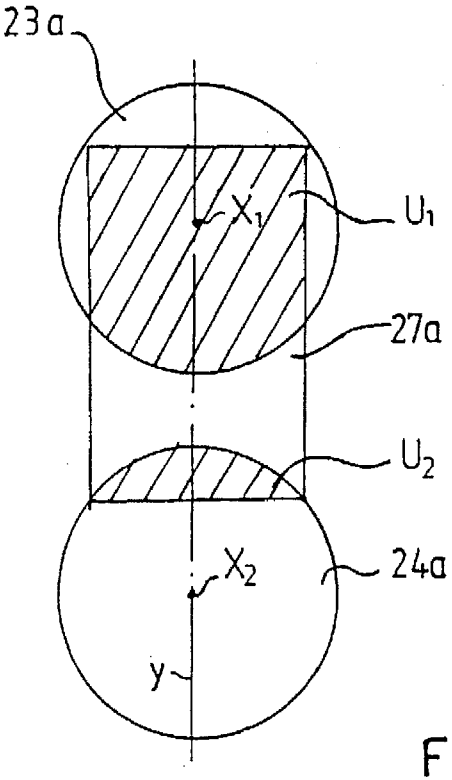
FIG. 4B shows a second position of flow regulation.
Figure 4C:
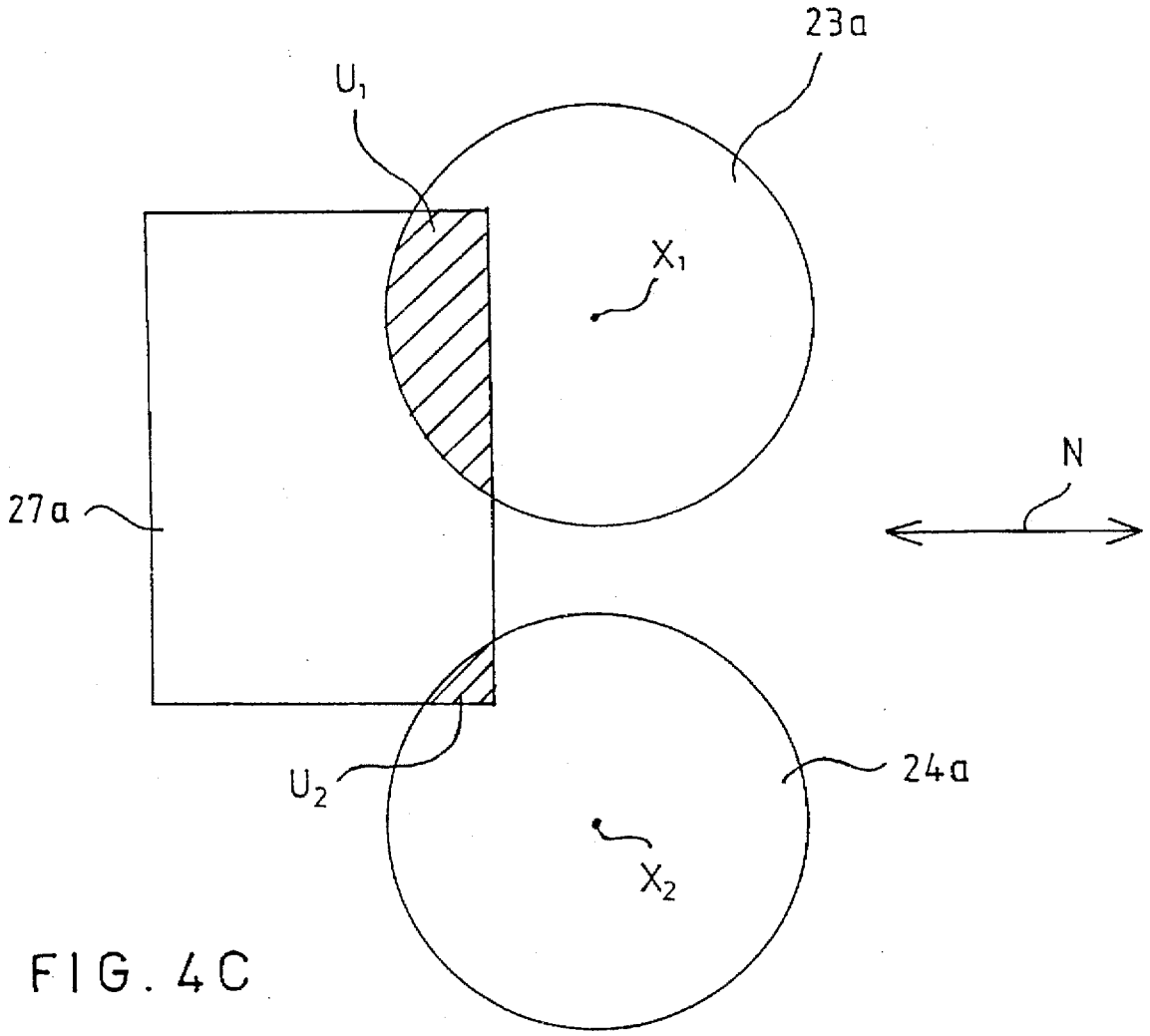
FIG. 4C shows a third position of flow regulation.

In FIGS. 4A, 4B and 4C, the regulation positions of the embodiment as shown in the embodiment of FIG. 3 is examined, wherein the distributor part includes a duct 27. It is noted though that the above examination also applies to the embodiment shown in FIG. 7, in which the distributor part 260 is a tumbler part, which does not include a separate transverse duct and by means of which tumbler part the end openings 23*a*,24*a* of the ducts 23,24 for the component flows are closed and opened.

When the distributor part 26 is shifted along a linear path in the manner shown in FIG. 4B, the sectional flow area $U_1$ of the component flow $Q_1$ coming from the duct 23 is increased, and the sectional flow area $U_2$ of the component flow $Q_2$ is reduced by a corresponding proportion. Thus, in the regulation, the mixing ratio is changed, but the sum of the flow quantities $Q_3=Q_1+Q_2$ remains invariable.

If it is desired to act upon the flow quantities of the flows $Q_{3.1}, Q_{3.2}, \ldots, Q_{3.n}$ in the manner shown in FIG. 4C, the distributor part 26 is shifted to the side (arrow $L_2$) (e.g., by rotation), in which case, at the same time, the sectional flow areas $U_1$ and $U_2$ are reduced. When the sectional flow areas $U_1, U_2$ are increased, the mixing ratio must remain unchanged. If $U_1$ was, in the initial situation, larger than $U_2$, then in the new position, $U_1$ is increased by a larger amount than $U_2$. In a corresponding manner, when the sectional flow areas $U_1$ and $U_2$ are reduced, and if $U_1$ is larger than $U_2$, the reduction of $U_1$ must be greater than the reduction of $U_2$. The valve mechanism in accordance with the invention achieves the maintaining of the mixing ratio invariable in the regulation of the flow quantity while varying the quantity of the total flow. Thus, in the regulation of the flow quantity, when the distributor part 26 is rotated, the pressure loss of the flow is affected, and thereby the velocity profile of the flow and further the fiber orientation profile are affected. The regulation does not affect the concentration of the flow $Q_3$, and thereby the concentration $D_3$ of the pulp suspension in the overall flow $Q_3$ flowing out of the duct 25 is kept at its desired regulated value.

Figure 5A:
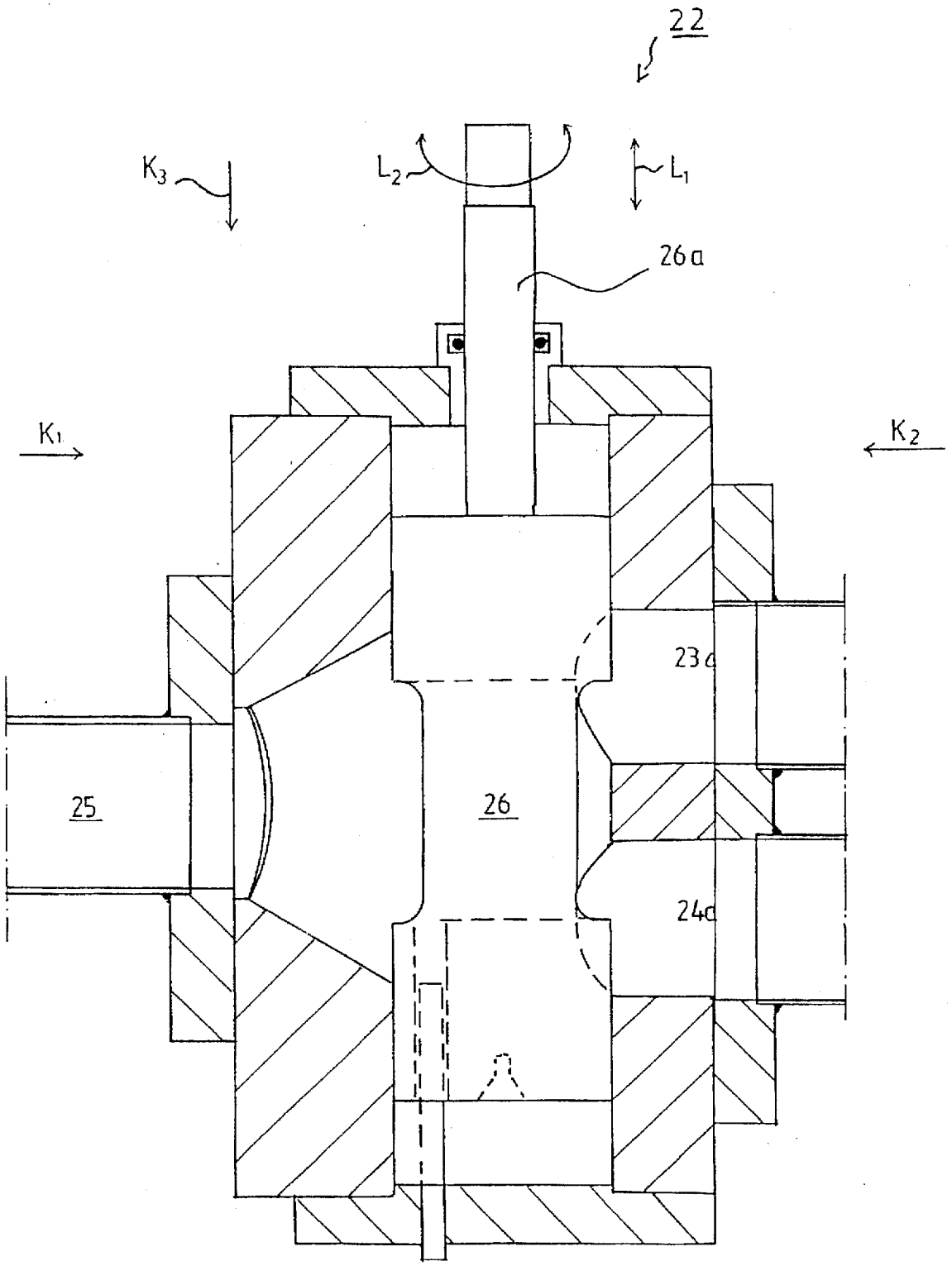
FIG. 5A is a sectional view of the mixer unit in accordance with the invention showing an embodiment of a mixer unit which corresponds to the illustrations of principle in FIG. 3 and in FIGS. 4A, 4B and 4C.

FIG. 5A is a sectional view of a first preferred embodiment of a mixer unit in accordance with the invention, which corresponds to the illustrations in FIGS. 3 and 4A, 4B and 4C. As described above, the mixer unit 22 comprises a first inlet duct 23 and a second inlet duct 24 as well as an exhaust or outlet duct 25. The mixer unit also comprises a chamber F in which the distributor part 26 is fitted to be displaceable along a linear path (arrow $L_1$) and in which it is fitted to be rotatable (arrow $L_2$).

When the distributor part 26 is displaced along a linear path perpendicularly to the inlet axes $X_1, X_2$ and $X_3$ of the ducts 23,24,25 (arrow $L_1$), respectively, the position of the inlet opening 27*a* of the transverse duct 27 in the distributor part 26 in relation to the end opening 23*a* of the first inlet duct 23 and to the end opening 24*a* of the second inlet duct 24 is affected. Thus, when the distributor part 26 is raised or lowered (arrow $L_1$), the flow is increased through the first inlet duct 23 into the transverse duct 27 in the distributor part 26, and the flow through the second inlet duct 24 is reduced by a corresponding amount, and vice versa. Thus, the mixing ratio between the component flow $Q_1$ coming from the inlet duct 23 and the component flow $Q_2$ coming from the other inlet duct 24 is changed, but the overall flow quantity Q3 of the component flows $Q_1, Q_2$ through the outlet duct 25 ($Q_3=Q_1+Q_2$) is kept invariable.

Out of the first inlet duct 23, preferably 0-water is made to flow. Out of the inlet duct 23, it is also possible to pass a pulp suspension whose concentration is, on the whole, different from the average concentration of the pulp suspension in the headbox, while the pulp having an average concentration is made to flow preferably through the second inlet duct 24.

When the distributor part 26 is rotated (arrow $L_2$), at the same time the throttle of the flow $Q_1$ coming out of the first inlet duct 23 and the throttle of the flow $Q_2$ coming out of the second inlet duct 24 are affected so that the flow resistances of the flows out of the ducts 23 and 24 are increased or reduced simultaneously. Thus, by rotating the distributor part 26, the pressure loss of the combined flow $Q_3=Q_1+Q_2$ is affected. When the pressure loss is increased or reduced, the flow quantity of the flow $Q_3$ through the outlet duct 25 is increased or reduced. In this manner, it is possible to affect the velocity profile of the flow and further the pulp fiber orientation profile at the desired position along the width of the paper machine in the desired way.

Figure 5B:
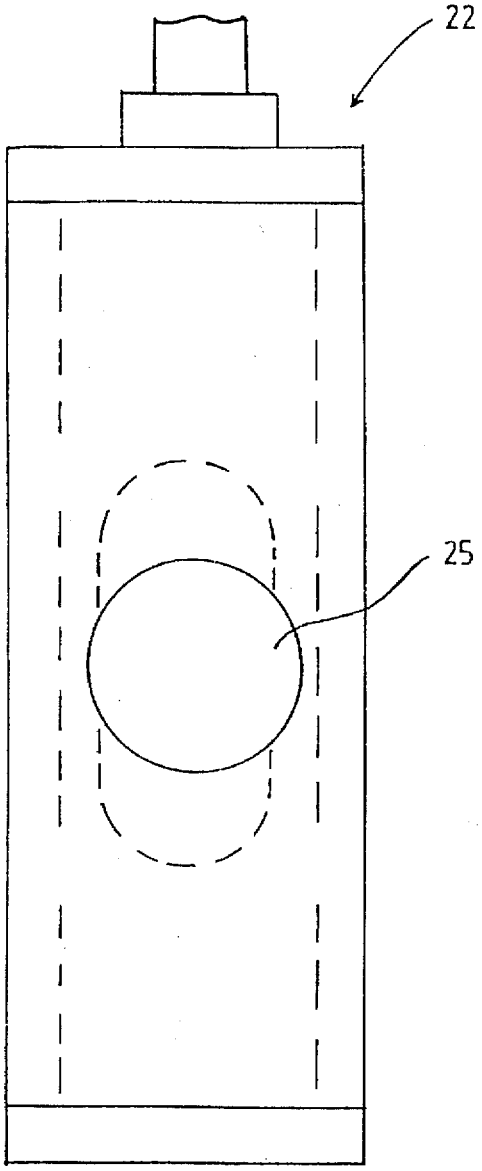
FIG. 5B is an illustration in the direction $K_1$ indicated in FIG. 5A.
Figure 5C:
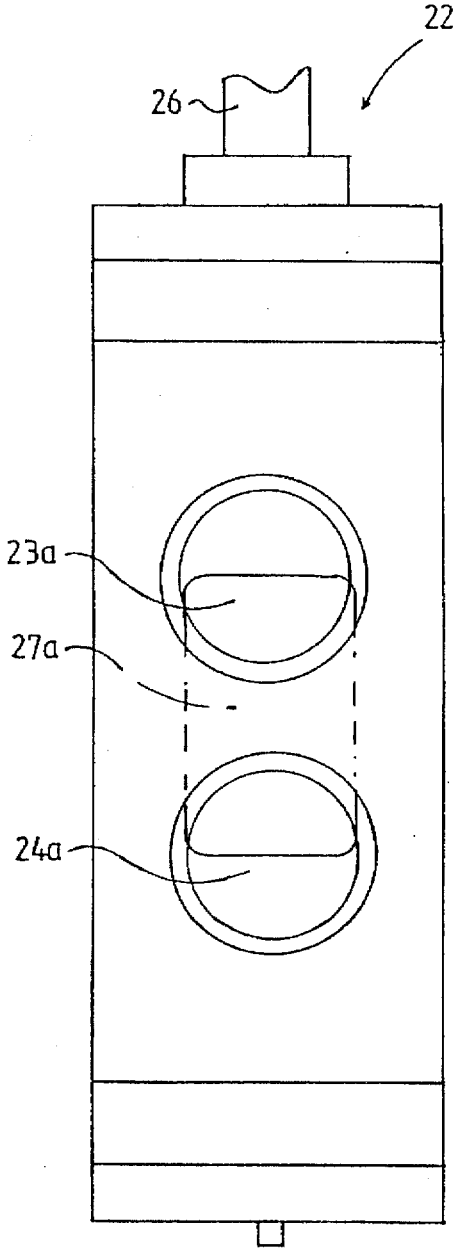
FIG. 5C is an illustration in the direction $K_2$ indicated in FIG. 5A.
Figure 5D:
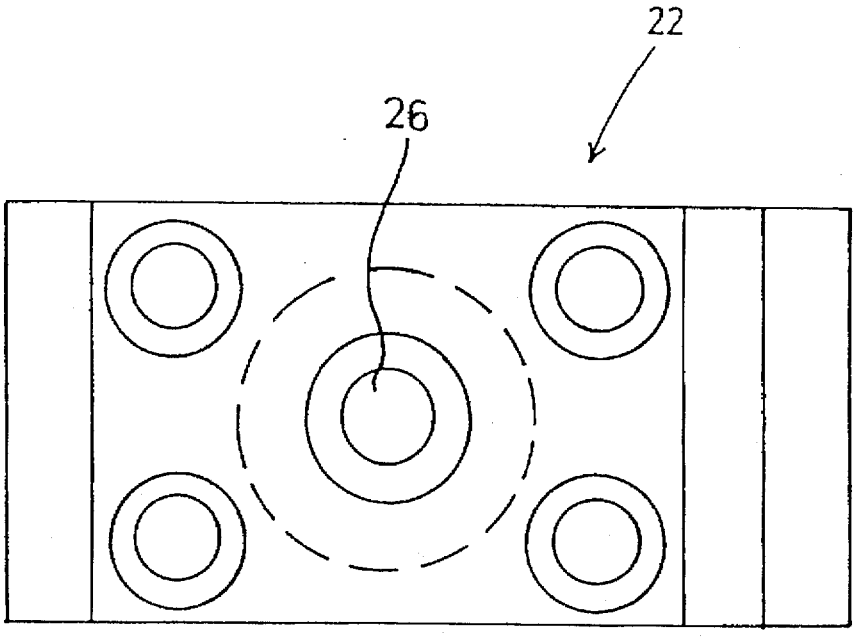
FIG. 5D is an illustration in the direction $K_3$ indicated in FIG. 5A.

The structure of the first preferred embodiment of the mixer unit shown in FIG. 5A is shown in more detail in FIG. 5B, which is illustration in the direction $K_1$ indicated in FIG. 5A, FIG. 5C which is an illustration in the direction $K_2$ indicated in FIG. 5A, and FIG. 5D, which is an illustration in the direction $K_3$ in FIG. 5A, i.e. from above.

Figure 5E:
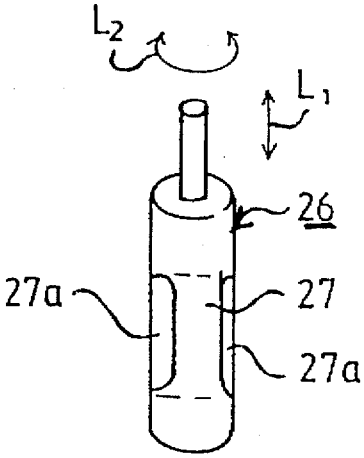
FIG. 5E is an axonometric view of the distributor part of the mixer unit.

FIG. 5E is an axonometric illustration of a disassembled distributor part 26 of the mixer unit 22 in accordance with the invention.

Figure 6A:
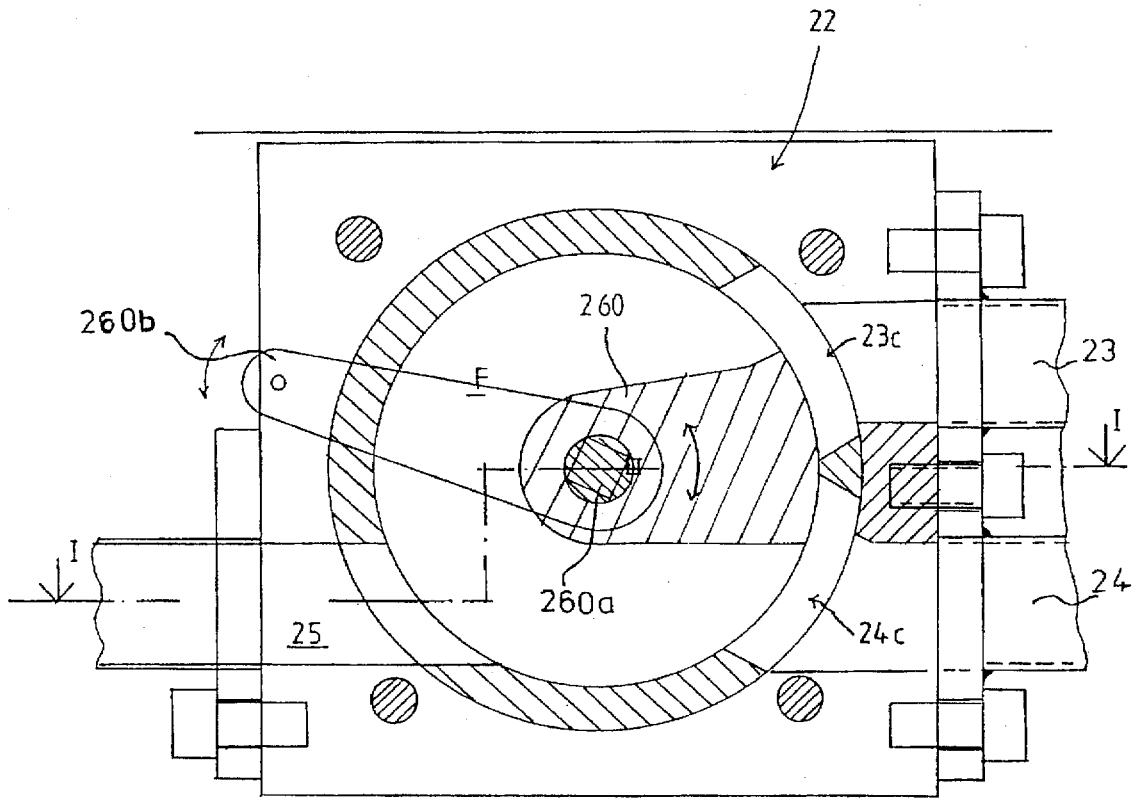
FIG. 6A is a sectional view of a second embodiment of the mixer unit in accordance with the invention, wherein the flow into the inlet chamber of the mixer unit is distributed by means of a separate tumbler piece, which is placed in different closing positions in relation to the inlet openings, in which case, when one inlet opening is being opened, the other inlet opening is closed by the corresponding amount.

FIG. 6A is a sectional view of a second embodiment of the mixer unit 22 in accordance with the invention. Also in this embodiment, the mixer unit 22 comprises a first inlet duct 23 and a second inlet duct 24 and an exhaust or outlet duct 25 through which the combined flow $Q_3=Q_1+Q_2$ is removed. A distributor part 260 is arranged in the mixer unit 22 and comprises a displacing spindle 260*a*, by whose means the distributor part 260 can be shifted into different covering positions in relation to the end opening 23*a* of the first inlet duct 23 and in relation to the end opening 24*a* of the second inlet duct 24. Through the first inlet duct 23, preferably 0-water is introduced. It is also possible to make such a pulp suspension flow through the duct 23 whose concentration is, on the whole, different from the average concentration of the pulp suspension in the headbox. However, the pulp suspension having an average concentration is made to flow preferably through the second inlet duct 24. Thus, in the manner shown in FIG. 6A, when the spindle 260*a* is rotated (arrow $L_3$), the distributor part 260, which operates as a tumbler part, is shifted into different covering positions in relation to the end openings 23*a*,24*a*. When the distributor part 260 is displaced, the end opening 23*a* of the inlet duct 23 is opened, and the end opening 24*b* of the inlet duct 24 is closed by the corresponding amount, and vice versa. As a result, in this embodiment, as in the embodiment shown in FIG. 5, the mixing ratio can be continuously regulated and, yet, the flow quantity or rate of the combined flow $Q_3$ remains invariable, i.e. the pressure loss remains at its invariable value.

The duct 24 is passed to, leads to, the desired position of width of the headbox of the paper machine. In the direction of width, the headbox of the paper machine comprises a number of ducts $25a_1$,$25a_2$ . . . , which are opened preferably into separate distribution pipes $28a_1$,$28a_2$ . . . , each of which passes directly into a turbulence tube $19a_1$,$19a_2$ . . . of its own placed in the same position of width in the turbulence generator 19.

Figure 6B:
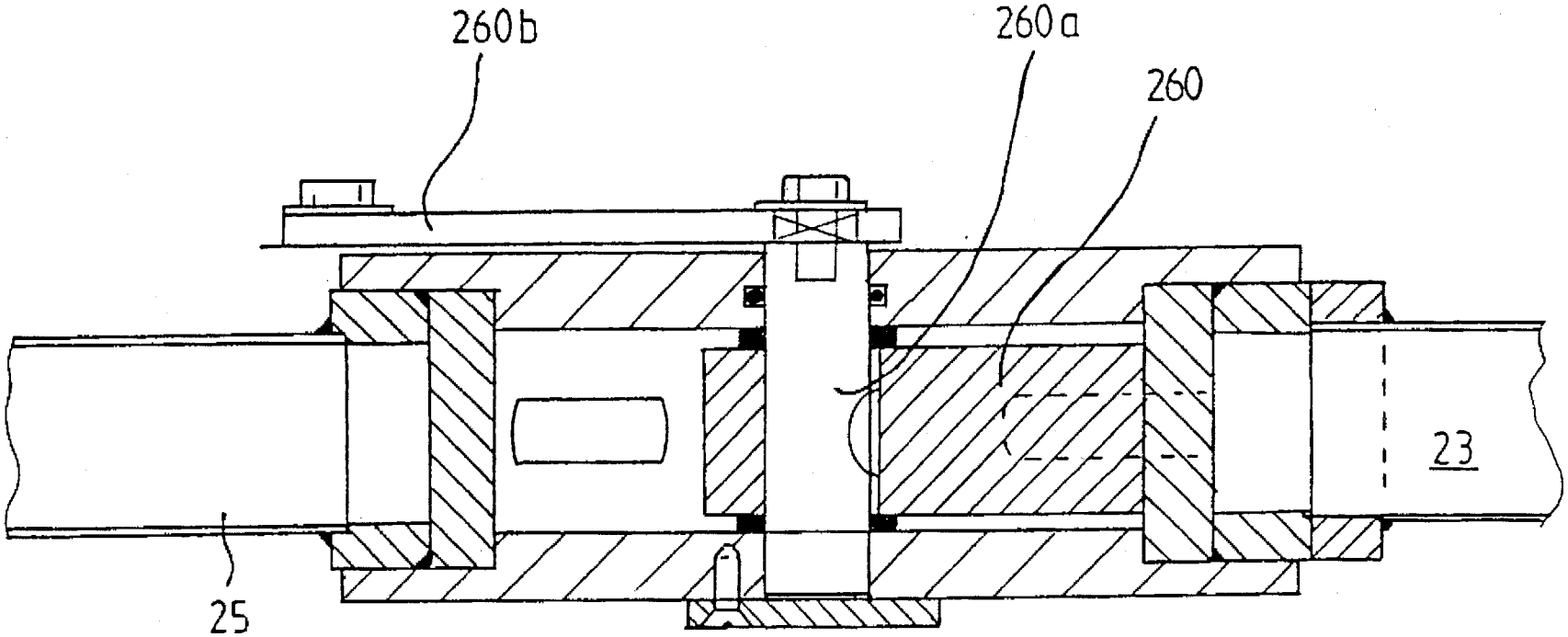
FIG. 6B is a sectional view taken along the line I—I in FIG. 6A.

FIG. 6B is a sectional view taken along the line I—I in FIG. 6A. The spindle 260*a* is rotated by means of the lever 260*b*.

Figure 7A:
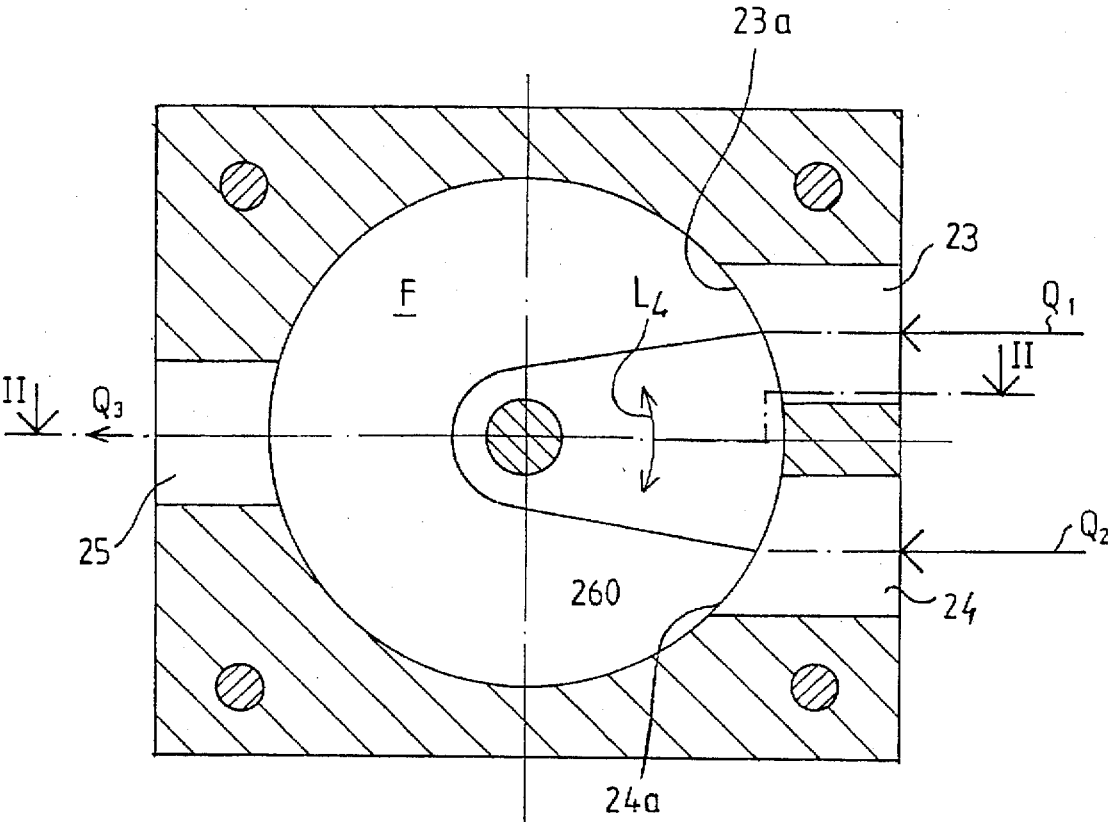
FIG. 7A is a sectional view of the mixer unit showing an embodiment of the invention corresponding to FIGS. 6A,6B, except that in the embodiment of FIG. 7A, the flow quantity of the departing flow can also be regulated.

FIG. 7A shows an embodiment of the invention which is in some respects similar to the embodiment of FIGS. 6A and 6B. However, in the embodiment shown in FIG. 7A, the flow quantity of the departing flow can also be regulated so that the mixing ratio remains at a regulated invariable value. In the embodiment of FIG. 7A, the spindle 260*a* is displaced along a linear path as indicated by the arrow $L_5$ in which case the distributor part 260 connected with the spindle is placed in different covering positions in relation to the end openings 23*a*,24*a* so that, at the same time, the end openings 23*a*,24*a* are closed or opened. The regulation of the mixing ratio takes place so that the spindle 260 is rotated (arrow $L_4$), whereby the distributor part 260 is shifted into different covering positions in relation to the end openings 23*a*,24*a*, and so that, when the sectional flow area of one end opening is increased, the sectional flow area of the other opening is reduced by the corresponding amount, and vice versa.

Figure 7B:
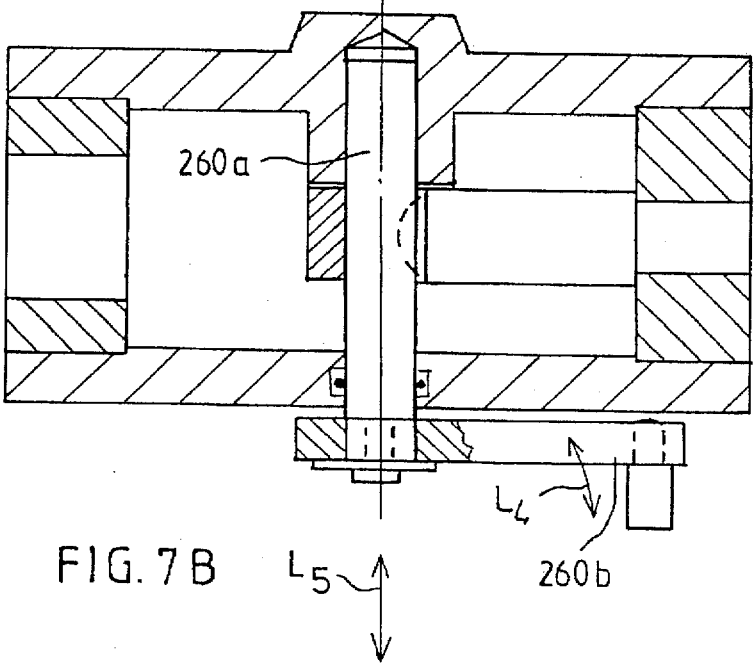
FIG. 7B is a sectional view taken along the line II—II in FIG. 7A.

FIG. 7B is a sectional view taken along the line II—II in FIG. 7A. In the manner indicated in FIG. 7B, by means of the arrow $L_5$, the distributor part 260 can be shifted along a linear path, whereby, at the same time, the end openings of the ducts 23 and 24 are opened or closed, in which case the throttle of the outlet flow $Q_3$ is reduced or increased while the mixing ratio of the flows $Q_1$ and $Q_2$ remains at its invariable value.

The examples provided above are not meant to be exclusive. Many other variations of the present invention would be obvious to those skilled in the art, and are contemplated to be within the scope of the appended claims.

We claim:

1. Method in the regulation of a pulp suspension flow in a headbox in which an additional medium flow having a regulated concentration is introduced into the pulp suspension at different points in a transverse direction of the pulp suspension, comprising the steps of:

forming said additional flow from at least first and second component flows, directing said at least first and second component flows into a chamber in a mixer unit in which said at least first and second component flows are mixed, regulating the concentration of said additional flow by displacing a distributor part arranged in said chamber in a first direction such that the flow rate of said first component flow into said chamber is adjusted relative to the flow rate of said second component flow into said chamber without affecting the total flow rate of said additional flow, and regulating the total flow rate of said additional flow by displacing said distributor part in a second direction such that the flow rates of said at least first and second component flows into said chamber are adjusted.

2. The method of claim 1, wherein the flow rates of said at least first and second component flows are adjusted relative to one another such that upon displacement of said distributor part in said first direction, the flow resistance of said first component flow is increased and the flow resistance of said second component flow is reduced.

3. The method of claim 1, further comprising the steps of:

directing said first component flow through an end opening of a first inlet duct into said chamber, directing said second component flow through an end opening of a second inlet duct into said chamber, and providing said distributor part with an outlet duct, such that upon displacement of said distributor part in said first direction, said outlet duct is positionable in different positions in relation to said end openings of said first and second inlet ducts to thereby adjust the flow rates of said at least first and second component flows into said chamber.

4. The method of claim 1, further comprising the steps of:

directing said first component flow through an end opening of a first inlet duct into said chamber, directing said second component flow through an end opening of a second inlet duct into said chamber, and displacing said distributor part into different covering positions to selectively close and open said end openings of said first and second inlet ducts.

5. The method of claim 1, further comprising the steps of:

connecting a spindle to said distributor part, and shifting said distributor part in said second direction along a linear path or rotating said distributor part in said second direction by means of said spindle to thereby adjust the flow rates of said at least first and second component flows into said chamber.

6. The method of claim 1, wherein said distributor part is shifted in said second direction such that the flow rates of said at least first and second component flows are increased or reduced simultaneously.

7. The method of claim 1, further comprising the steps of:

directing said first component flow through an end opening of a first inlet duct into said chamber, and directing said second component flow through an end opening of a second inlet duct into said chamber, wherein said first direction is a direction perpendicular to a line connecting central axes of said end openings of said first and second inlet ducts, and said second direction is a direction perpendicular to said first direction.

8. The method of claim 1, further comprising the step of providing said first component flow with a concentration different than the concentration of said second component flow.

9. A device for regulating a pulp suspension flow in a headbox in which an additional medium flow having an adjustable concentration is introduced into the pulp suspension at different points in a transverse direction of the headbox, comprising a mixer unit having a chamber from which said additional flow is passed, inlet ducts having end openings in flow communication with said mixer unit through which at least first and second component flows of said additional flow are passed into said mixer unit, adjustment means for regulating the concentration of said additional flow and for regulating the total flow rate of said additional flow, said adjustment means comprising a displaceable distributor part arranged in said chamber, means for displacing said distributor part in a first direction into different covering positions in relation to said end openings of said inlet ducts to thereby regulate the concentration of said additional flow by adjusting the flow rates of said at least first and second component flows into said chamber relative to one another without affecting the total flow of said additional flow, and means for displacing said distributor part in a second direction into different covering positions in relation to said end openings of said inlet ducts to thereby regulate the total flow rate of said additional flow by adjusting the flow rates of said at least first and second component flows into said chamber.

10. The device of claim 9, wherein said distributor part is displaceable in said first direction into different covering positions in relation to said end openings such that the flow rate of said first component flow is increased and the flow rate of said second component flow is reduced by a corresponding amount.

11. The device of claim 9, wherein said distributor part comprises a duct having a mouth opening alignable with said end openings, said mouth opening being movable into different positions relative to said end openings.

12. The device of claim 9, wherein said means for displacing said distributor part in a first direction and said means for displacing said distributor part in a second direction comprises a shifting spindle for displacing said distributor part.

13. The device of claim 9, wherein said mixer unit comprises an outlet duct through which an outlet flow comprising a mixture of said component flows is passed, said first direction being a direction perpendicular to a line connecting the central axes of said end openings such that the concentration of said additional flow is regulatable for a specific distribution ratio of said at least first and second component flows, said distributor part being displaced by rotation in said second direction such that the flow rates of said at least first and second component flows are increased or reduced simultaneously for a specific mixing ratio.

14. The device of claim 9, wherein said mixer unit comprises only two of said inlet ducts through which two respective component flows pass.

15. The device of claim 9, wherein said distributor part is a displaceable tumbler part rotatable into different covering positions in relation to said end openings.

16. The device of claim 15, wherein said means for displacing said distributor part in a first direction and said means for displacing said distributor part in a second direction comprises a shifting spindle for displacing said distributor part into different covering positions in relation to said end openings, and a lever coupled to said spindle for rotating said spindle to thereby displace said distributor part.

17. The device of claim 9, wherein said mixer unit further comprises an outlet duct through which an outlet flow is passed, said outlet flow constituting a mixture of said at least first and second component flows to form said additional flow.

18. A headbox of a paper machine, comprising a first inlet header, means for carrying a first pulp suspension flow from said first inlet header, said means comprising a plurality of first inlet ducts arranged in a transverse direction of the first pulp suspension flow, a second inlet header, means for carrying an additional medium flow from said second inlet header, said means for carrying on additional medium flow comprising a plurality of second inlet ducts arranged in the transverse direction of the headbox, mixing means for mixing the first pulp suspension flow passing through individual ones of said plurality of first inlet ducts with the additional medium flow passing through respective individual ones of said plurality of second inlet ducts to form a mixed pulp suspension flow, said mixing means comprising a plurality of mixer units, said first and second inlet ducts having end openings through which the first pulp suspension flow and the additional flow, respectively, are passed into said plurality of mixer units each of said plurality of mixer units having a chamber and adjustment means for regulating the concentration of said additional flow and for regulating the total flow rate of said additional flow, said adjustment means comprising a displaceable distributor part arranged in said chamber, means for displacing said distributor part in a first direction into different covering positions in relation to said end openings of said inlet ducts to thereby regulate the concentration of said additional flow by adjusting the flow rates of said first and second component flows into said chamber relative to one another without affecting the total flow of said additional flow, means for displacing said distributor part in a second direction into different covering positions in relation to said end openings of said inlet ducts to thereby regulate the total flow rate of said additional flow by adjusting the flow rates of said first and second component flows into said chamber, a discharge duct for discharging a pulp suspension jet from said headbox, means for passing a second pulp suspension flow from said first inlet header to said discharge duct, and means for passing the mixed first pulp suspension flow and the additional medium flow from said plurality of mixer units to said discharge duct to combine with said second pulp suspension flow.

19. A device for regulating a pulp suspension flow in a headbox in which an additional medium flow having an adjustable concentration is introduced into the pulp suspension at different points in a transverse direction of the headbox, comprising a mixer unit having a chamber from which said additional flow is passed, inlet ducts having end openings in flow communication with said mixer unit through which at least first and second component flows of said additional flow are passed into said mixer unit, and adjustment means for regulating the concentration of said additional flow and for regulating the total flow rate of said additional flow, said adjustment means comprising a displaceable and rotatable distributor part arranged in said chamber, a rotatable spindle connected to said distributor part and a movable lever connected to said spindle, said distributor part being displaceable upon rotation of said spindle movement into different covering positions in relation to said end openings of said inlet ducts to thereby regulate the concentration of said additional flow by adjusting the flow rates of said at least first and second component flows into said chamber relative to one another without affecting the total flow of said additional flow, and said spindle and said distributor part being displaceable upon movement of said lever in a direction of an axis of rotation of said spindle such that said distributor part is displaced into different covering positions in relation to said end openings of said inlet ducts to thereby regulate the total flow rate of said additional flow by adjusting the flow rates of said at least first and second component flows into said chamber.

* * * * *